US009102493B2

(12) United States Patent
Lam

(10) Patent No.: US 9,102,493 B2
(45) Date of Patent: Aug. 11, 2015

(54) TAPE MONITORING SYSTEM

(71) Applicant: Joe Augustine Lam, Vancouver (CA)

(72) Inventor: Joe Augustine Lam, Vancouver (CA)

(73) Assignee: LAMUS ENTERPRISES INC, Vancouver (CA)

( * ) Notice: Subject to any disclaimer, the term of this patent is extended or adjusted under 35 U.S.C. 154(b) by 442 days.

(21) Appl. No.: 13/573,657

(22) Filed: Oct. 2, 2012

(65) Prior Publication Data

US 2014/0094354 A1 Apr. 3, 2014

(51) Int. Cl.

| | |
|---|---|
| ***G08B 21/00*** | (2006.01) |
| ***B65H 35/00*** | (2006.01) |
| ***B65H 26/02*** | (2006.01) |
| *B65B 51/06* | (2006.01) |
| *B65B 57/04* | (2006.01) |

(52) U.S. Cl.

CPC ..... *B65H 35/0013* (2013.01); *B65H 26/02* (2013.01); *B65B 51/067* (2013.01); *B65B 57/04* (2013.01); *B65H 2403/92* (2013.01); *B65H 2511/52* (2013.01); *B65H 2515/706* (2013.01); *B65H 2551/20* (2013.01)

(58) Field of Classification Search

CPC ..... B65H 35/0013; B65H 26/02

USPC ..... 340/540

See application file for complete search history.

(56) References Cited

U.S. PATENT DOCUMENTS

| | | | | |
|---|---|---|---|---|
| 4,855,006 | A | 8/1989 | Marchetti | |
| 5,507,907 | A * | 4/1996 | Kropp et al. | 156/350 |
| 5,735,101 | A | 4/1998 | Lam | |
| 6,204,760 | B1 * | 3/2001 | Brunius | 340/529 |
| 7,665,498 | B2 | 2/2010 | Bredl et al. | |
| 2004/0154749 | A1 * | 8/2004 | Rice | 156/363 |
| 2009/0058663 | A1 * | 3/2009 | Joshi et al. | 340/584 |

* cited by examiner

*Primary Examiner* — Kerri McNally
(74) *Attorney, Agent, or Firm* — C. A. Rowley

(57) ABSTRACT

In general, the present invention comprises of a control unit with a tape applicator with operative members to selectively actuate sensors of a multiple sensor arrangement each of which is positioned to detect movement or position caused by a carton or the dispensing tape; specifically, the signal caused by the present of the carton; the movement caused by the dispensing tape as the carton being taped, and a further signal actuated based on the size (depletion) of the dispensing tape roll. The detected signals from the sensors are sent to a control unit with a multiple timing circuit or a preprogrammed micro processor with predetermined sequences and time values to generate and emit a correspond alarm signal based on the following control logics.

8 Claims, 4 Drawing Sheets

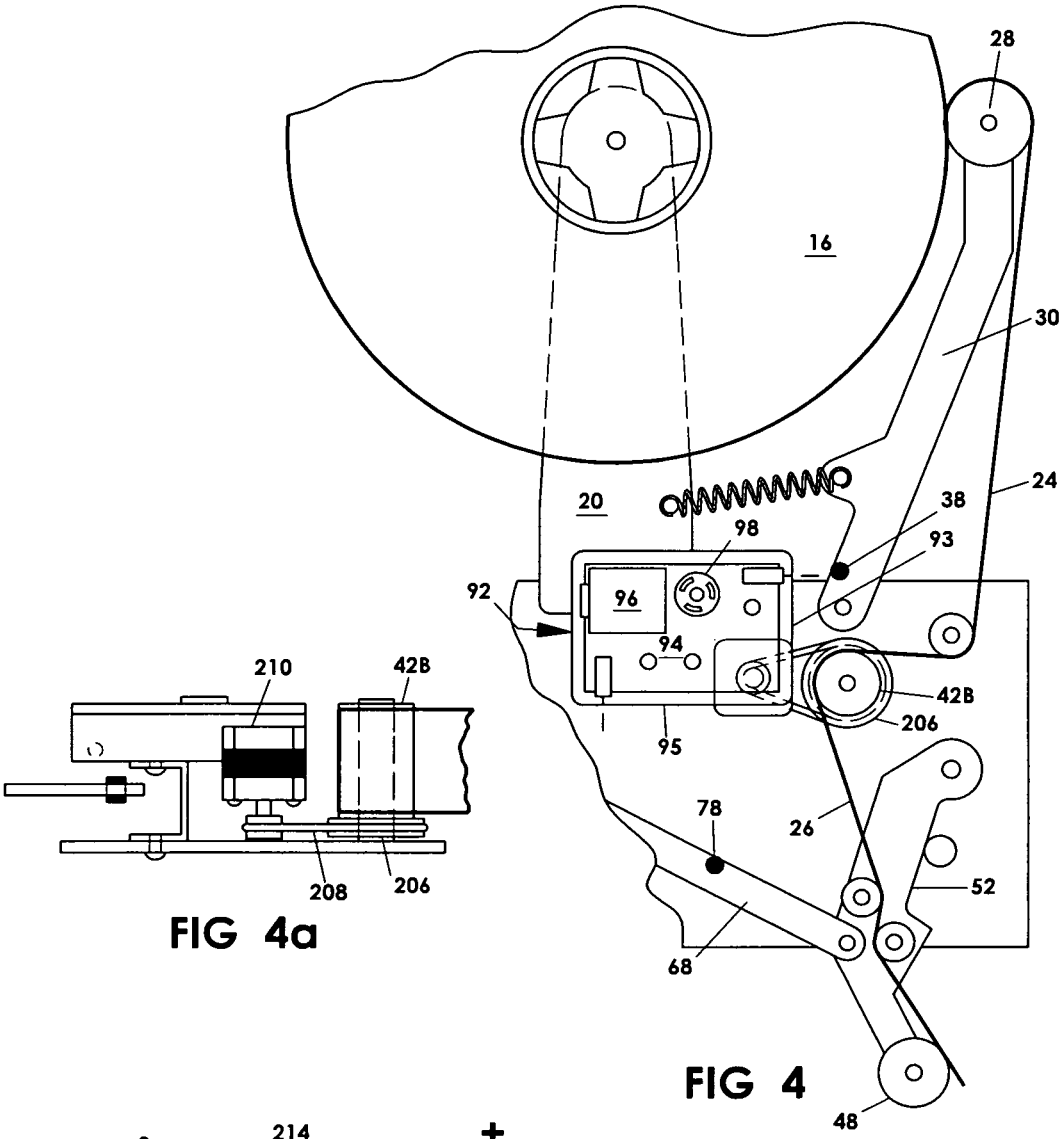
FIG 4
FIG 4a
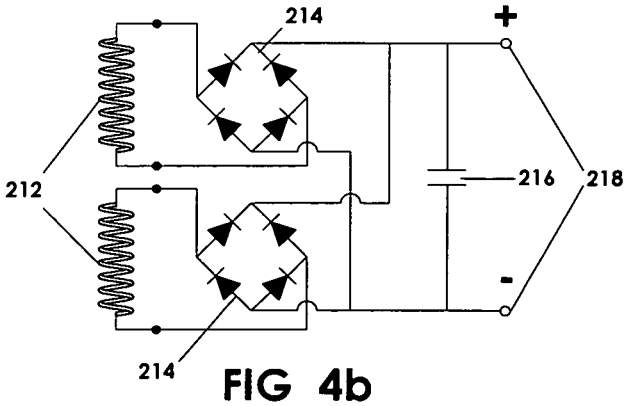
FIG 4b

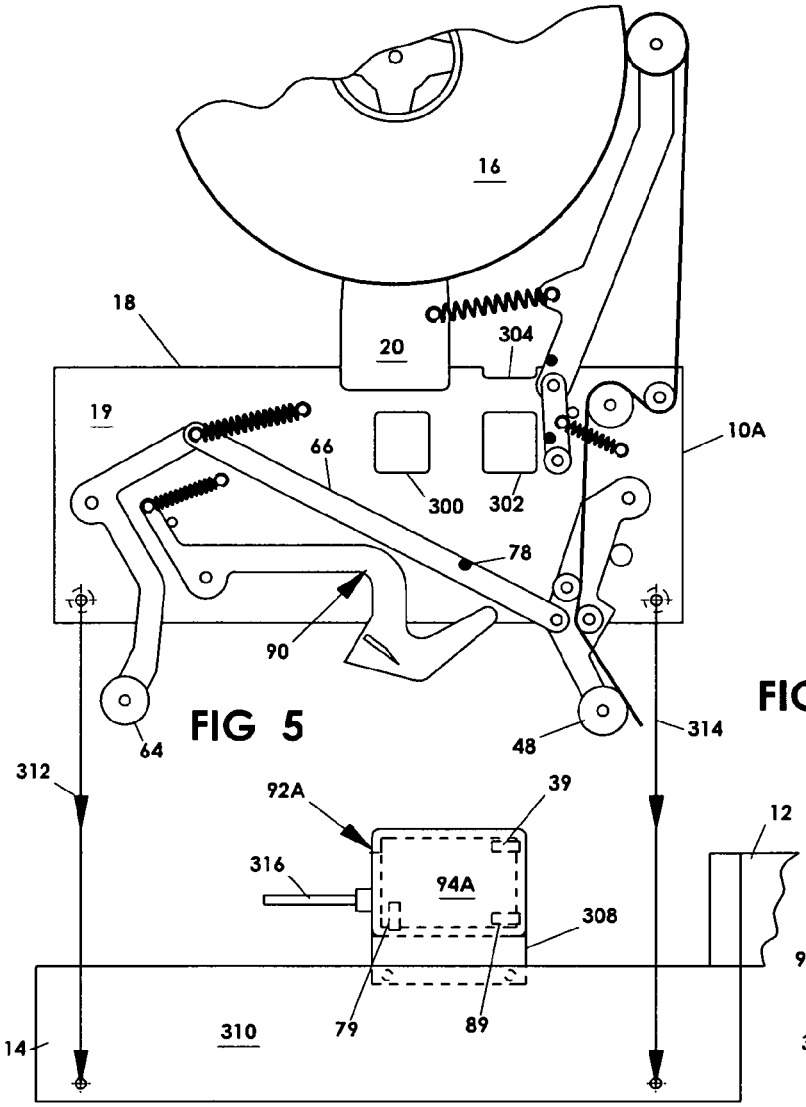
FIG 5
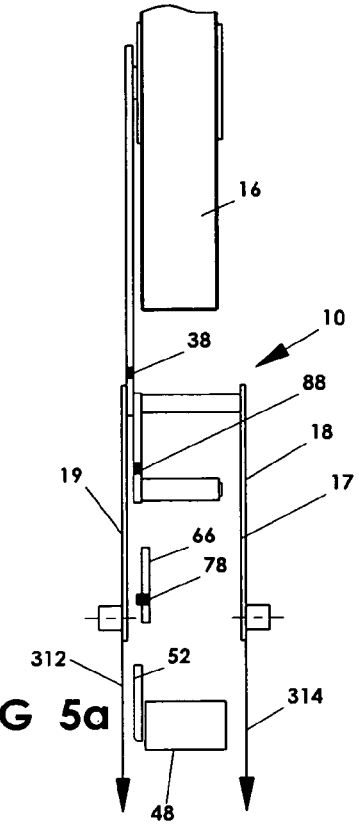
FIG 5a
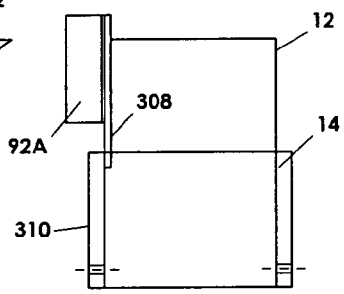
FIG 6
FIG 6a
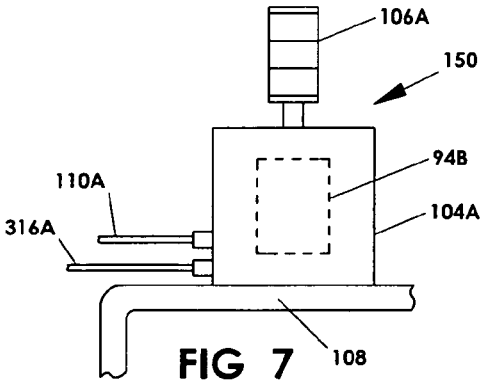
FIG 7
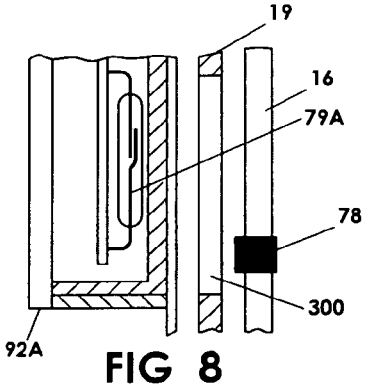
FIG 8

TAPE MONITORING SYSTEM

FIELD OF INVENTION

The present invention relates to a tape monitoring system for tape applicators such systems operating to detect and identify taping malfunction conditions during the taping operation and provide an alarm signal. More particularly the system may detect and signal malfunctions due to low tape; tape breakage; tape not applied; tape not being cut or carton jamming.

BACKGROUND OF THE PRESENT INVENTION

The idea of providing a tape monitoring system for tape applicator is not in itself new Applicant is aware of U.S. Pat. No. 4,855,006 Issued Aug. 8 1989 to Marchetti; U.S. Pat. No. 5,507,907 issued Apr. 16, 1996 to Kropp et al; U.S. Pat. No. 5,735,101 issued Apr. 7, 1998 to Lam; and U.S. Pat. No. 7,665,498 issued Feb. 23 2010 Bredl et al. Marchetti teaches a system that uses a cam sensing means that detects rotation of a cam the rotation of which is generated by tape movement and provides a warning signal if the tape is not moving as required. Lam teaches the use of a feeler arm to detect the tape. Kropp et al provides an improvement over Marchetti and teaches the incorporation of a tape dispensing sensor and a box presence sensor connected to a control system that in effect shuts down the machine if an error signal is detected. This patent also describes a tape supply sensor which senses the tape on the tape roll and sends an error signal if the tape roll is about to be depleted. Bredl et al teaches a more elaborate system than the teachings of either of the above patents but uses much of the teachings of Kropp et al., provides for the tape dispensing sensor and the object detecting system (box detector) being positioned independent of the tape head and uses a relatively complicated system that includes comparing velocity, counting, encoding, measuring current of the conveyor motor, etc., to generate signals for the control system.

Adhesive tape closure is one of the most common methods used in the packaging industry to seal the top and/or bottom of a carton due to its simplicity and low cost of materials and equipment, particularly in the foods and drugs industry since it can provide a dust-proof carton closure. However, it is also recognized in the packaging industry that there are two major considerations regarding tape sealing: (1) Restricted tape Length: A roll of tape can seal an average of about 2,000 carton (top only) so that the tape supply roll has to be replaced depending on the production rate about once an hour; and (2) tape quality and application variants: the quality, material, thickness, adhesive formula and the release coating of adhesive tape is not always consistent which in itself may impose problems during the taping operation and the carton taping operation is intermittent (e.g. between cartons there is no tape being applied) so that the tape being applied is subjected to varying speeds, stresses and tensions during each carton taping cycle, and which result may cause tape snap back after cutting, flagging, tape breakage, and other problems such as no tape, tape not cut and other undesirable conditions. Other issues related to taping include temperature; substrate surface condition; adhesive penetration; adhesion holding force; under-filled carton; shelf life of tape; handling of tape roll; tape applicator; dull cutting blade and carton jamming caused by the tape applicator, etc. are factors of production downtime and defective carton closure in tape sealing.

One of the biggest issues with current machines without suitable warning devices, etc. is where the operator cannot easily determine the amount of tape remaining which in some cases results the machine operating after tape roll is completely depleted and untapped cartons discharge. In many cases this problem is exacerbated as cartons with the top or bottom flaps un-taped go unnoticed. Most tape being used is clear and transparent which adds to the difficulty of visual inspection for un-taped cartons. This problem is even more significant with automatic or semi-automatic equipment.

There are many tape detection sensing systems that have been proposed and that suggest different methods to address the abovementioned problems, however, the majority of tape applicator or taping machines currently used are not equipped with any tape monitoring systems.

There are a number of reasons end-users do not use the tape monitoring systems currently available:

(1) High cost: The monitoring system has to monitor two separate tape applicators in an off-set top and bottom positions in one machine which requires many sensors, connections and wiring as well as separated programs or control circuits for each tape applicator. It is only possible to install the system to the machine at the factory with many modifications, wiring and programming involving highly qualified personnel. The system involves engineering and customization for different makes and models of taping machine and thus is not suitable for mass production and becomes a very significant cost when applied to a taping machine. (see U.S. Pat. No. 7,665,498; and U.S. Pat. No. 5,507,907 referred to above).

(2) Complexity: All tape monitoring system in the market uses a control panel mounted on the machine with a programmable Logic Control (PLC) or electrical control circuit and human interface to turn on; off, and reset the system, the control is mounted on the taping machine with sensors connected to the tape applicators (see U.S. Pat. No. 5,735,101)) and photo sensors on the conveyor or the machine frame (see U.S. Pat. No. 7,665,498) for carton detection. The wiring and connections have to allow machine adjustments and disconnection of the tape applicator from the taping machine. Only qualified electrician can service, adjust or repair the system, which discourages users with limited in-house technical personnel.

(3) Ease of use/Effectiveness: Most of the tape monitoring systems involve sensors and power connections between the tape head or the tape roll holding arm to the control panel which is inconvenient and subject to damages since the tape head requires frequent removal from the machine for replenishing of a depleted tape roll, the wires have to be disconnected for removal and reconnected for re-installing. In some cases, the operator may just ignore the time consuming connection, particularly the electrical connection to the bottom tape applicator and as a result the system is inoperative (U.S. Pat. No. 5,735,101 and U.S. Pat. No. 5,507,907); A pneumatically operated system requires an air supply connection to the tape applicator (U.S. Pat. No. 4,855,006 (Marchetti)). An extended length cable or pneumatic hose may be used for connection to the tape applicator without disconnection; however, it is undesirable to incorporate an unprotected loose length of cable or air hose as this is hazardous and can easily result in system damage. Furthermore, all systems provide an ON/OFF switch to power the system and a Reset switch to disable and reset the alarm signal. Operators tend to forget to reset the system after attending to the problem or sometimes may just turn off the system if the distress signal is too annoying. The present invention teaches a system that includes automatic shut off and reset of the monitoring system to thereby significantly reduce this operator problem.

Some tape monitoring systems incorporate the signal output from the monitor to turn off the machine, which is not preferable for most automatic production operation since it may cause more carton or product jamming problems to the up-stream packaging process causing more production down time (U.S. Pat. No. 5,507,907 and U.S. Pat. No. 4,855,006).

The normal practice is to maintain a non-stop production process, re-taping the defective carton manually or with an off-line semi-automatic tapping machine.

Tape monitoring systems available in the market do not have an effective system of detecting and warning of "Case-jamming". A solution that addresses the "carton-jamming" problem during the taping operation is not known in tape monitoring systems. The tape applicator is a mechanical device with tape applying rollers that intersect with the incoming carton and are moved by the carton during the taping operation which applies forces between the carton and machine that must be overcome. Carton stalling or jamming occurs is more prevalent when tapping light weight, under-filled or soft cartons which may collapse when tape is being applied. This undesirable condition occurs even with normal well-packed cartons where the commonly used conveyor belt is badly worn or has not been properly adjusted to provide sufficient force to move the carton through the tape applicator. The present invention is able to detect and provide a warning for this condition.

(4) Food Safety Modernization Act (FSMA) by USFDA: A new law that has come into force in 2011 as a response to a succession of food recalls in the US has stringent regulations imposed on food and drug related products. According to Packaging Machinery Manufacturers Institute (PMMI), the new law has a major impact on packaging equipment manufacturers in setting higher standards and requirements to provide equipment with a "clean design" or accessibility for cleaning, eliminating any potential area of contamination. Most mechanical parts can be converted into stainless steel with ease of removal for wash-down and vacuum cleaning. Among all "clean design" criteria, electrical instruments, multiple wiring and connections are the most difficult design issues since all these devises cannot easily be removed for cleaning. Cleaning on electrical devises can also be hazardous if not performed properly. Most electrical cables and instruments generate heat which propagates bacteria growth. The food and drug industry is the major user of tape and taping equipment. As opposed to most tape monitoring system in the market, the present invention to address the "clean design" criteria as required by FSMA.

The present invention provides solutions to some of the above problems by providing a system that is less costly to install and that eliminates the necessity for loose lengths of cable or air hose and reduces wiring and connections within the system and between the tape applicator and the machine.

BRIEF DESCRIPTION OF THE PRESENT INVENTION

It is an object of the present invention to provide a tape monitoring system and a tape applicator to ensure proper taping in a carton sealing operation by providing warning and/or control signals to better insure the necessary action is taken to correct the problem.

Broadly the present invention relates to a tape monitoring system for use with a tape applicator forming part of a carton sealing machine having a machine frame and used to apply an adhesive tape ribbon to a carton to seal said carton, means for moving said carton past said tape applicator, at least a portion of said tape applicator being removable from said carton sealing machine for replacement of a depleted roll of tape, said tape monitoring system comprising, a control unit for generating output signals that produce output alarm signals to indicate the status of each taping cycle, multiple sensors including a tape roll depletion sensor that senses depletion of a tape roll, a tape feed sensor that senses miss-application of tape to a carton being taped by said tape applicator and a box feed sensor that senses when a box is present in the carton sealing machine said sensor being activated by a corresponding signal activator for each said sensor mounted on said tape applicator, said sensors being connected to said control unit to communicate therewith so that said control unit may generate said output alarm signals and a power source for said control unit.

Preferably, the sensors are mounted on said tape applicator and the power source is a rechargeable battery and more preferably a power generator driven by movement of said tape is used to generate electrical power to charge the rechargeable battery during the taping operation and that may also serve as a miss-application sensor.

Preferably after a preselected time said box feed sensor combines with said tape feed sensor through said control unit to detect box jamming of a carton in said tape applicator Preferably, the sensors are in positioned in close proximity to each other in a sensing station that preferably is mounted on the machine frame.

A preferred form the control unit is coupled to output alarm signal devices that preferably are in the form of a signal emitter remote from the tape applicator.

It is preferred that the box feed sensor also be used as a power ON switch to turn on the power to the said control unit.

It is also preferable that the control unit be programmed to stop and reset automatically after a predetermined time duration.

BRIEF DESCRIPTION OF THE SEVERAL VIEWS OF THE DRAWINGS

Further features, objects and advantages will be evident from the following detailed description of the preferred embodiments of the present invention taken in conjunction with the accompanying drawings in which;

FIG. 4 shows a tape applicator similar to FIG. 1 with parts omitted for clarity, incorporating the present invention with a power generator coupled to the operative member of the tape applicator.

FIG. 4*a* is a bottom view of the generator arrangement as shown on FIG. 4, illustrating the coupling and mounting of the generator between the operative member (tape roller as shown) of the tape applicator, the control unit of the present invention mounted on the base frame of the applicator and the relative position of the signal target or activator on the operative member of the tape applicator (magnet on push bar as shown).

FIG. 4*b* is a schematic of an electrical schematic circuit of a rectifying circuit converting the AC power generated from the generator as shown on FIG. 4*a* into DC power. (Rectifying circuit).

FIG. 5 shows the tape applicator similar to FIG. 1 identified with signal targets on its operative members with windows cut-out on the base frame allowing for signal detection externally of the tape applicator. The tape applicator is at its normal home position with a full roll of tape and ready to be installed onto the machine mounting bracket of FIG. 6

FIG. 5*a* is an end elevation of FIG. 5 with parts omitted for clarity, illustrating the relative positions of the signal targets or activators on the operative members of the tape applicator.

FIG. 6 showing another embodiment of the present invention of the control unit enclosed with the sensing station, installed on one side of the mounting bracket of the machine frame at the location corresponding to the installed position of the tape applicator.

FIG. 6*a* shows the end elevation of FIG. 6, illustrates the mounting position of the sensing station of the present invention, indicating the sensing station is mounted to one side of the mounting bracket in close proximity to the signal targets on the operative members of the tape applicator.

FIG. 7 shows a signaling station containing the control unit and an alarm tower light mounted on the machine frame with power supply cable and a signal cable to be connected to the sensing station as indicated on FIG. 6

FIG. 8 is a cross section partial view of the control enclosure containing a PCB and sensor (reed sensor as shown); the related tape applicator's frame and the signal target or actuator (permanent magnet is shown) on an operative member of the tape applicator of the present invention.

DETAILED DESCRIPTION OF THE INVENTION

Figure 1A:
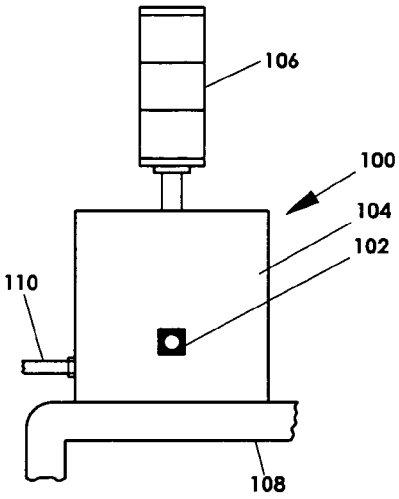
FIG. 1*a* shows an alternative embodiment of a remote station with a wireless signal receiver devise (IR receiver as shown) and an alarm tower light on top of the enclosure which is installed on top of the machine frame.
Figure 1:
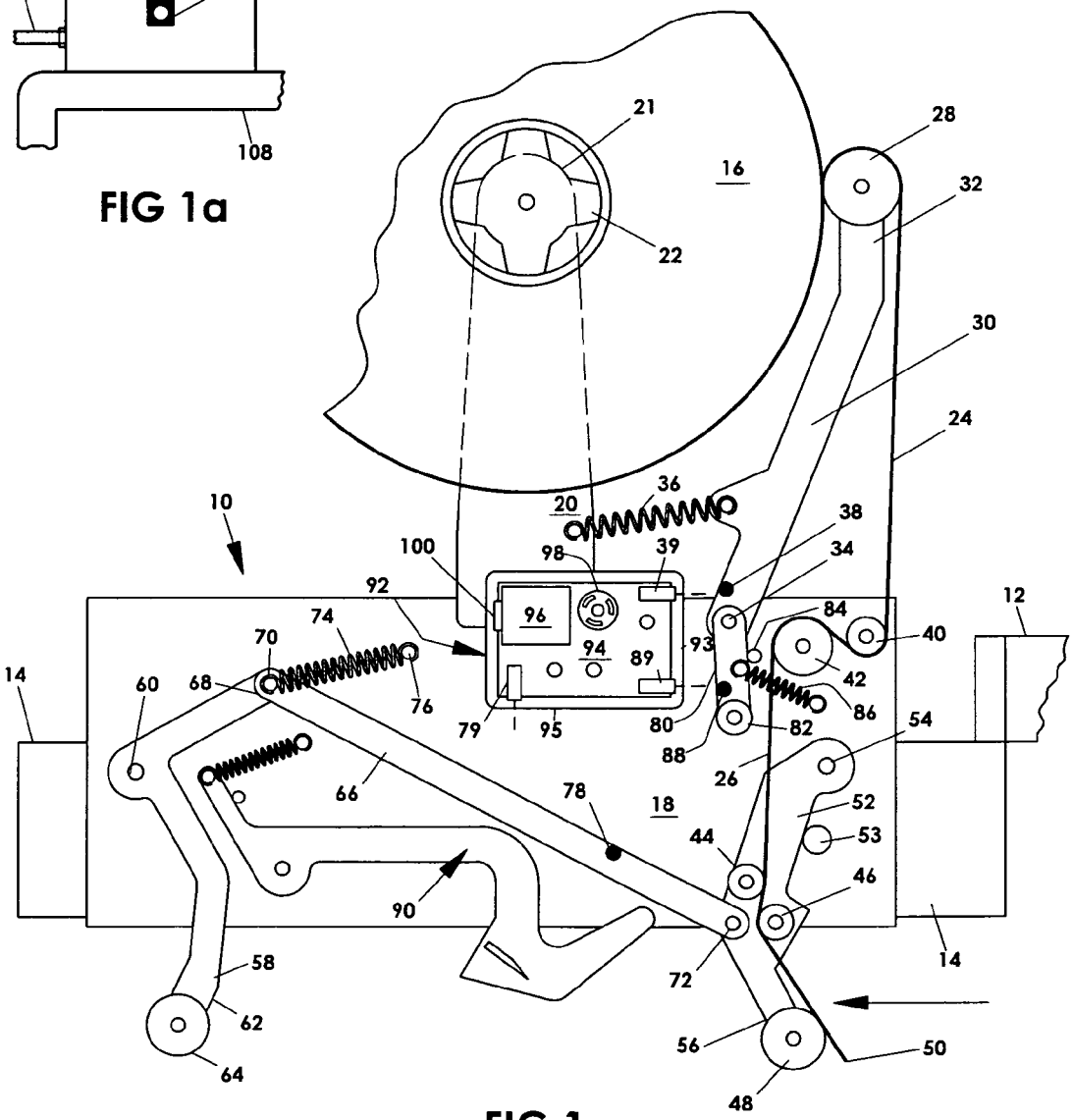
FIG. 1 is a side elevation that schematically illustrates a tape applicator incorporating various part of the present invention applied to a conventional tape applicator or tape head.

Turning to FIG. 1 the present invention is shown applied directly to a tape applicator or tape head 10 shown mounted in the conventional manner on a carton sealing machine 12 portions of the frame 14 of which are schematically shown on opposite ends of the tape head 10 (see also FIGS. 5 and 6 described below). The tape head 10 is removably mounted to the machine 12 in the conventional manner to permit easy replacement of a depleted tape roll (a full tape roll is shown at 16 in Figure) and to perform any required maintenance.

The tape head 10 includes a frame 18 on which the various operating parts of the tape head are mounted. The tape roll support arm 20 is mounted on and extends from the frame 18 and has adjacent to its free end 21 a rotatable spindle or the like 22 on which the tape roll 16 is mounted and from which a ribbon of tape as indicated at 24 is dispensed along a tape path 26 also shown by the tape 24. In the tape head 10 illustrated the tape path 26 (and thus the tape 24) passes over the dancer roll 28 mounted on the dancer arm 30 adjacent to its free end 32. The dancer arm 30 is pivotably mounted to the frame 18 of the tape head 10 via axel 34 and its free end 32 is biased toward the roll 16 to hold the roll 28 in contact with the periphery of the tape roll 16 via a spring 36 that extends between the arm 30 and the support arm 20 as shown. The dancer arm 30 has a tape roll target or sensor activator 38 mounted thereon spaced from the pivot or axel 34 so that it moves into a sensing range for its low tape depletion sensor 39 to activate same when the tape roll 16 approaches depletion as occurs when the dancer arm 30 pivots on axel 34 and brings the tape roll target or activator 38 into the sensing range of its corresponding tape roll depletion sensor 39.

The tape 24 following the tape path 26 extends over guide rolls 40, 42, 44 and 46 to a front applicator roll 48 that applies a leading end 50 of a tape 24 to an on-coming box (not shown in FIG. 1) that is to be taped. The roll 42 will normally include a one way clutch to permit movement of tape 24 on path 26 towards the applicator roll 48

In the illustrated tape head 10 the front applicator roll 48 and the guide rolls 44 and 46 are mounted on a front applicator arm 52 which adjacent to one end is pivotable mounted to the frame 18 as indicated at 54. The applicator roll 48 is rotatably mounted on the arm 52 adjacent to its free end 56 remote from the mounting 54.

A rear applicator arm 58 is pivotably mounted on the frame 18 on pivot 60 positioned between a first free end 62 adjacent to which a rear applicator 64 roll is mounted on the arm 58. A push bar 66 is pivotably connected as indicated at 70 adjacent to one end thereof to the rear applicator bar 58 adjacent to its free end 68 on the opposite side of pivot 60 to its free end 62. The opposite end of the push bar 58 is pivotably connected as indicated at 72 to the front applicator aim 52 between its pivotal mounting 54 and the applicator roll 48. A suitable spring 74 that extends between the end 68 of the arm 58 and the frame 18 as indicated at 76 biases the applicator arms 52 and 58 to receiving position ready to receive the next carton or box to be taped with the arm 52 pressed against the stop 53 that is mounted on the frame 18.

The push bar 66 has a box present or box feed sensor target or a sensor activator 78 fixed thereto between the pivots 70 and 72 in a position such that during normal operation a box passing the tape applicator 10 moves the front applicator arm 52 and it moves the push bar 66 and thus the arm 58 and target 78 into a range or position to be detected by its corresponding box present sensor or box feed sensor 79.

Also pivoted on the pivot mounting 34 in the embodiment shown in FIG. 1 is a sensor arm 80 having a contact roller 82 rotatably mounted thereon adjacent to the end of the arm 80 remote from the pivot 34. The arm 80 is biased toward the tape path 26 and is held against a stop 84 via a spring 86 that extends between the arm 80 and the frame 18. A tape feed target or sensor activator 88 is mounted on the arm 80 and is moved into sensing position relative to is corresponding tape feed sensor i.e. the tape feed sensor 89 when the tape path 26 is displaced by movement of the front applicator arm 52 as a result of a box (not shown in FIG. 1) moving the roll 48 and thereby pivoting the arm 52 on pivot 54 so that the tape 24 contacts the contact roll 82 to move the arm 80 and thereby the tape feed target or sensor activator 88 into the sensing range of its corresponding tape feed sensor 89 that senses miss-application of tape to a carton being taped.

The conventional cut off mechanism 90 has been shown and is activated and operated in conventional manner so will not be described further.

In the preferred arrangement the sensors 39, 79 and 89 are all contained within a sensor station 92 which also contains a control unit 94 which provides for a very clean and effective way to mount the sensors and a control unit parts of the monitoring system and is of particular importance when the sensing station 92 is mounted directly to the tape applicator machine 12 frame 14 as will be described below. The sensing station is a relatively small container or space having a maximum dimension of less than 8 inches and when applied to the tape head such as the tape head 10 a thickness or height less that the spacing between the opposed frame members 17 and 19 of the frame 18 (see FIG. 5*a*). This sizing and centralizing of the key components of the tape monitoring system is obtainable by the unique positioning of the targets or sensor activators 38, 78 and 88 as taught by the present invention wherein these targets or sensor activators 38, 78 and 88 when in the range of their respective sensors 39, 79 and 89 respectively are in close proximity to two adjacent sides 93 and 95 of the sensing station 92 and are each in the required proximity of their respective sensor to activate such sensor (see FIGS. 1, 2 and 3). In the prior art arrangements the targets or sensor activators where position in different location around the tape head or on the machine which did not permit the use of a sensing station equivalent to the station 92 that incorporates all of the sensors and the monitoring unit and the alarm or alarm trigger as well as the on board power source 96 which may be in any suitable form such as a battery 96 or a capacitor (not shown) as required when the monitoring system is to be mounted on the tape head 10 and an on board power source provides significant advantage as opposed to when the sensing station 92 incorporating sensors 39, 79 and 89 is mounted on the machine 12 as will be described below with reference to FIGS. 6-7.

The control unit 94 when the monitoring system is mounted directly to the tape applicator 10 as opposed to the machine frame 14 to be effective must be battery driven or (or other portable power source used such as a capacitor that may be mounted on the tape head 10) the problems with cables, etc. referred to above will be incurred and the use of the system severely curtailed. Thus a battery 96 is illustrated and used to power the sensors 39, 79 and 89 as required, to power the control unit and to drive the warning device 98. Preferably the battery 96 is a rechargeable battery and a recharging port as indicated at 100 may be provided or simply the battery may be removed for charging and replaced with a charged replacement battery. The use of battery power such as used in a cell phone or computer technologies to applicant's knowledge has never been applied to taping machines particularity to operate monitoring systems but as is evident from the present invention it overcomes problems that have plagued the industry for decades.

In FIG. 1 an alarm emitter is shown at 98 however if desired this emitter 98 may be changed to a remote controller 98 such as a wireless or infra red or the like transmitter to send signal to a remote signal emitted 100 as shown in FIG. 1*a* which has a signal receiver as indicated at 102 to receive signals from the transmitter 98 and includes an alarm station 104 that based on signals received via receiver 100 from the transmitter 98 trigger warning signals such as light for example a red color LED light indicating a taping problem (such as tape breakage or tape not being applied, tape not being cut or case jamming) and an orange color LED indicating low or depleted tape supply or sirens which in this case are in or on a tower 106. The remote signal emitter 100 may be used with more than one tape applicator machine or tape head and is preferably mounted on a portion 108 the frame 12 of a tape application machine so that a fixed power source as indicated at 110 and that need not be moved may be used to power the remote signal emitter 100, thereby avoiding the problems of the prior art.

Figure 2:
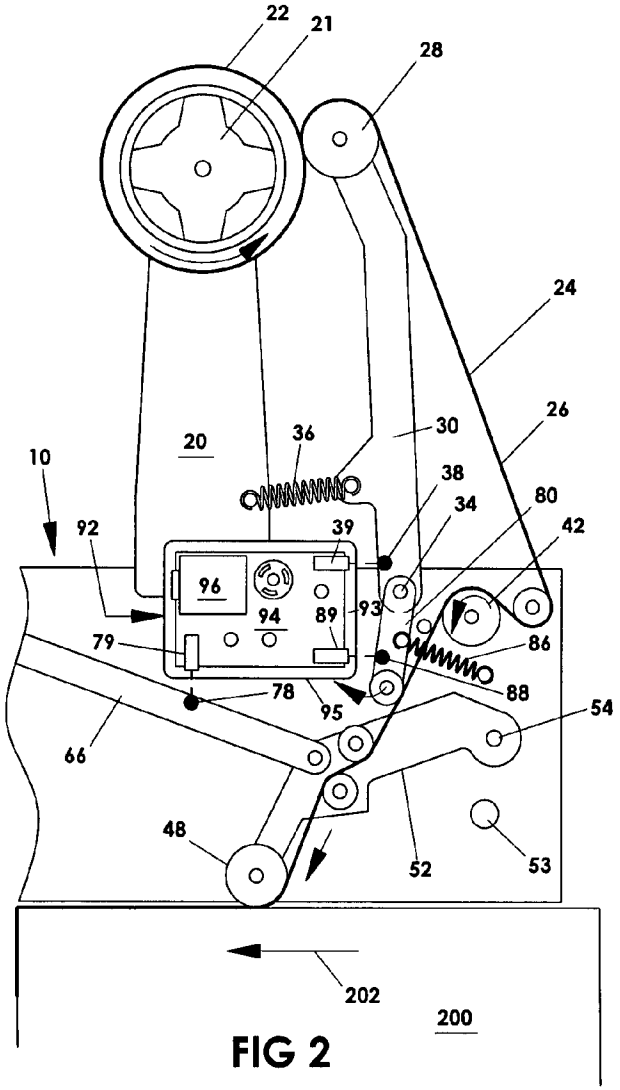
FIG. 2 shows the applicator as shown on FIG. 1 applying tape on a carton indicating the sensor activation positions of the dancer arm which indicate tape roll condition; the operative member indicating the presence of a carton; and another operative member indicating that tape is being dispensed for application to the container or carton.

FIG. 2 shows the tape head with monitoring system of the present invention as show and described with reference to FIG. 1 but with the targets or sensor activators 38, 78 and 88 all in triggering position relative to their respective sensor 39, 79 and 89. In these positions the sensors 79 and 89 are activated—see below for the discussion on sensors 79 and 89; when the sensor 39 detects the target 38 is close and that therefore the tape roll 16 must be nearly depleted the control unit 94 sends the corresponding alarm signal.

The control unit generally indicated at 94 will normally incorporate a multiple timing circuit or a preprogrammed micro processor (both of which are well known) with predetermined sequences and time values covering a range of carton length and a range of carton speeds used in most operations to generate and emit a corresponding alarm signal based on the following control logics:

(1) From the time of the incoming carton's 200 (see FIG. 3 or 4) initial detection by the tape applicator i.e. when in the illustrated system box feed or box present target 78 is moved into position to activate box feed or box present sensor 79 by the incoming box 200 (see FIG. 2 or 3) displacing the roll 48 and the sensor 79 activates the control unit 94. The box 200 moves through the machine in the direction represented by the arrow 202 (which also schematic represents any suitable means for moving the carton 200 through the machine) It will be apparent that this box feed or box present sensing system that includes the sensor 79 and target 78 if it is to be used solely to initiate operation of the control unit 94 (trigger the control unit 94 to begin monitoring) it may be replaced by known sensor systems conventionally used to turn on a tape monitoring system and thus would constitute a box feed or present sensor.

(2) It normally requires about 0.2 second before the tape 24 starts to dispense and applies onto the carton. A 0.3 second time value is preset into the program or timer to generate a tape miss-feed signal e.g. "no-tape" or "Tape-breakage" signal based on the target or actuator 88 not being in the range of the tape feed sensor 89 after 0.3 second from triggering the unit by box feed sensor 79. (or the tape feed sensor provided by the generator 210 as will be described below with reference to FIGS. 4 and 4*a*)

(3) It requires a normal 1 to 2.5 seconds to tape a carton 200 depending on the conveyor speed and the length of the carton. Thus a 3 seconds time value (or a time selected specific to the carton being taped and the carton feed speed to be used) may be set or programmed for into the program or timer to emit an "Un-cut tape" signal should the tape continue to be dispensed as determined by the tape feed actuator or target 88 continuing to be sensed by the tape feed sensor 89 after the preset 3 seconds.

(4) Should no movement of tape being dispensed be sensed by the tape feed sensor 89 (or the tape feed sensor 89 provided by the generator 210 as will be described below with reference to FIGS. 4 and 4*a*) coupled with the target or activator 78 remaining in sensing range of the box feed or box present sensor 79 for more than 3 seconds, a "Case-jam" signal is generated, indicating the carton is stalled under the tape applicator since it normally takes 1 to 2.5 seconds for the carton to clear the tape applicator.

(5) Provide for automatic shut off and reset of the monitoring system after a preset time after the power to the control unit has been turned on preferably as above described by the box feed sensor operating as power ON switch to turn on the power to the said control unit. Preferably the control unit 94 is to be programmed to provide a pre-set time duration of the generated alarm signal and programmed to de-activate and reset automatically. Both these alternative programs will reduce operator interface requirements for the system as well as conserving power from the battery when a battery is used as the power source.

The programmed times described above for example the 1 to 2.5 second range are based on the production time the carton normally would take to be taped in the machine under the then current operating conditions: the longer production time to tape a carton the longer the programmed times will be set to. production time is determined by the machine speed and the length of the carton being taped: as will be apparent the slower the machine speed and the longer the cartons the longer the time for the carton to pass through the machine (production time) and vice versa that is why the programmed times are preset to accommodate a normal range of carton length and speed for most operations to minimize adjustments.

It is preferred to use non-contact proximity sensors or reed sensors (see FIG. 8) which allows switching actuation with permanent magnet spaced a short distance apart (e.g. up to about ¾ inch in any direction i.e. sensing zone of about 1½ inches in diameter). A reed switches using a permanent magnet signal target to actuate the reed sensor without any power consumption as an advantage to conserve power from the battery; alternatively, a ferrous metal signal target may be used to actuate an electrical proximity sensor or a mark (Dark or Light color) signal target may also be used to actuate a photoelectric sensor, however such a detector may be direction sensitive but they constantly consume power.

Figure 3:
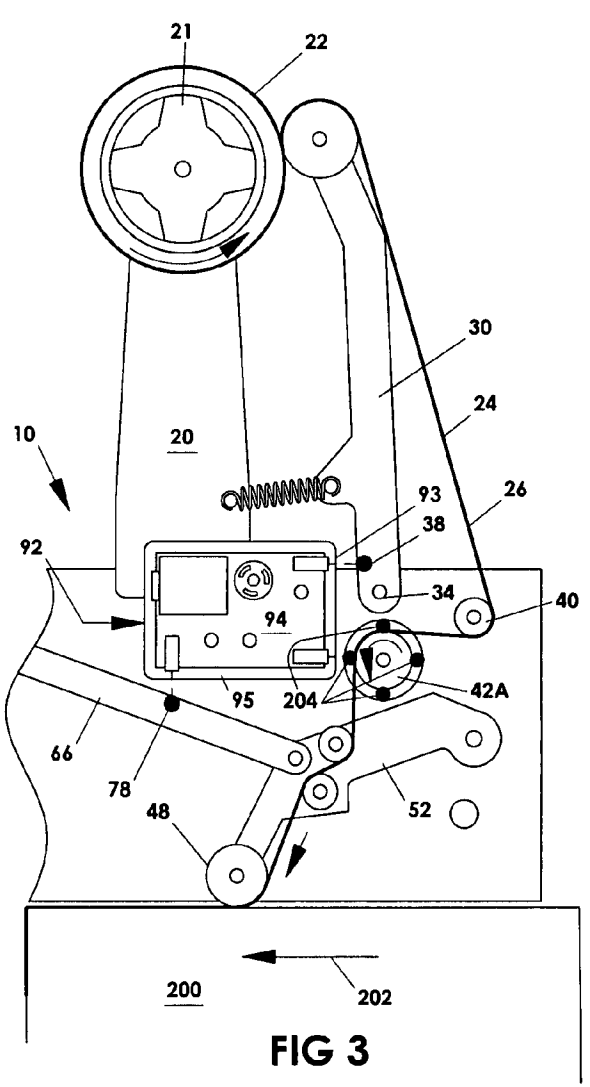
FIG. 3 is a view similar to FIG. 2 showing an alternative sensor activation system with sensor activators or targets on the body of a roller driven by the tape.

FIG. 3 shows essentially the same tape head and monitoring system as FIGS. 1 and 2 but uses a different target or sensor activator namely in the illustrated version 4 targets 204 evenly spaced circumferentially around the roll 42A which replaces the roll 42 are used in place of the arm 80 and target 88. As the roll 42A is rotated by the tape 24 the targets 204 come within range of the sensor 89 i.e. directly opposite the tape feed sensor 89 they are detected and cannot be detected by the sensor 89 when out of range e.g. on the side of the roll 42A remote from the sensor 89. If desired the rate of detection of the targets 204 in pulses, counts or sequence may be used and determine by appropriately programming a microprocessor in the control unit 94.

FIGS. 4 and 4*a* show a further alternative wherein the target 88 and/or 204 have been eliminated and the roll 42 and/or 42A replaced by a roll 42B which has a drive pulley 206 at one axial end thereof that drives a belt or the like 208 which in turn drives a power generator 210 which generates electrical power when driven by movement of the tape 24 turning the roll 42B (it is also possible to build a generator into the roll 42B but this is more difficult and more expensive). The power generated may be monitored by any suitable means that will form part of the control unit 94 and the reading used to generate a tape feed signal it will provide a tape feed sensor equivalent to or to replace the tape feed signal from the tape feed sensor 89 and the term tape feed sensor is intended to include this sensor. The power generator 206 preferably is a stepper motor the output of which is rectified via a suitable circuit as schematically shown in FIG. 4*b* and the direct current (DC) output as indicated at 218 used to charge the rechargeable battery 96 or a suitable size capacitor (not shown). The stepper motor coils 212 in known manner is each connected to its respective rectifier circuit 214 and their outputs bridged by a suitable capacitor 216 to provide the DC output as indicated at 218. (It is known that a stepper motor or a DC permanent magnet motor can be used to generate electric power, however, to the applicant's knowledge such a power generator has not been applied in a tape monitoring system. This is significant as it eliminates the requirement for any electrical connection to the tape applicator or having to re-charge the battery with an external power source periodically since the tape applicator is generating the power to charge the battery during the taping operation).

FIGS. 5 to 8 show the invention applied to (mounted on) the frame 14 of the machine 12 as opposed to the frame 18 of the tape head 10. The tape head 10A in FIG. 5 is essentially the same as the tape head 10 described above with reference to FIG. 1 but has been modified by removing the station 92 from the tape head 10A and if required (depending on the type of trigger or sensor activator used and the material from which the frame member 19 of the tape head frame 18 is made) providing windows 300 and 302 there through as required to provide signaling access between the sensors in the illustrated arrangement sensors 79 and 89 to their respective trigger or sensor activators 78 and 88. The sensor 39 has access to its trigger or sensor activator 38 via the cut out 304 in the frame of the tape head 10A.

As shown in FIG. 6, 6*a* the sensor station 92A is mounted via bracket 308 to the frame member 310 of the frame 14 of the tapping machine 12 and is position so that when the tape head 10 or 10A as required is moved as indicated by the arrows 312 and 314 into operative position a the respective sensors 79, 89 and 39 align with their respective window 300, 302 or cut out 304 to have direct access to their respective targets 78, 88 and 38. In this arrangement the sensors 39, 79 and 89, if required, are oriented toward the side of the tape head 10 or 10A relative to their orientation in FIG. 1 so that they are in effect aimed across the machine. (as above indicated with non-contact proximity sensors or reed sensors (see FIG. 8) aiming direction is not important as the sensor is activated when the target is within its sensing zone). The signal are preferably transferred by wire 316 to a remote signaling control station 150 as shown on FIG. 7 which is mounted on the machine frame 108. In the embodiment with the sensor station mounted to the machine as opposed to the tape head or applicator 10 the control unit as indicated at 94B is positioned in the station 150 which also has the alarm tower light 106A and a power source connection 110A FIG. 8 shows a specific type of sensor (sensor 79A used as the sensor 79 in the illustrated arrangement of FIG. 8 but equally applicable to the other sensors 39 and/or 89) known as a non-contact proximity sensor or reed sensors which as above described is effective it the target is in a sensing zone surrounding the sensor general the zone will have a diameter of about 1½ inches, the reed of which is displaced by attraction to a permanent magnet which is in this embodiment used as the target 78 (and/or 38 and/or 88).

Having described the invention, modifications will be evident to those skilled in the art without departing from the scope of the invention as defined in the appended claims.

I claim:

1. A tape monitoring system for use with a tape applicator forming part of a carton sealing machine having a machine frame and used to apply an adhesive tape ribbon to a carton to seal said carton, means for moving said carton past said tape applicator, said tape monitoring system comprising: a control unit for generating output signals that produce output alarm signals to indicate the status of each taping cycle; multiple sensors including a tape roll depletion sensor that senses depletion of a tape roll, a tape feed sensor that senses miss-application of tape to a carton being taped by said tape applicator, and a box feed sensor that senses when a box is present in the carton sealing machine; each said sensor being activated by a corresponding signal activator for each said sensor on said tape applicator; said sensors being connected to said control unit to communicate therewith so that said control unit may generate said output alarm signals; a power source for said control unit; said sensors, said control unit and its power source for operating said control unit being mounted on said tape applicator, said power source is a rechargeable battery, and a power generator driven by movement of said tape to generate electrical power to charge the rechargeable battery during the taping operation.

2. A tape monitoring system as defined in claim 1 wherein said signal activator for said miss-application sensor is said power generator.

3. A tape monitoring system as defined in claim 1 wherein said box feed sensor activates said control unit when said box feed sensor senses a carton to be taped in a tape applying position.

4. A tape monitoring system as defined in claim 1 wherein said box feed sensor combines with said tape feed sensor through said control unit to detect box jamming of a carton in said tape applicator.

5. A tape monitoring system as defined in claim 1 wherein said miss-feed sensor is coupled to said control unit via a time delay means requiring a selected time delay before said control unit generates said output alarm signal.

6. A tape monitoring system for use with a tape applicator forming part of a carton sealing machine having a machine frame and used to apply an adhesive tape ribbon to a carton to seal said carton, means for moving said carton past said tape applicator, said tape monitoring system comprising: a control unit for generating output alarm signals to indicate the status of each taping cycle; multiple sensors including a tape roll depletion sensor that senses depletion of a tape roll, a tape feed sensor that senses miss-application of tape to a carton being taped by said tape applicator, and a box feed sensor that senses when a box is present in the carton sealing machine; each said sensor being activated by a corresponding signal activator for each said sensor mounted on said carton sealing machine; said sensors being connected to said control unit to communicate therewith to generate said output alarm signals; and said control unit and said sensors being arranged in close proximity to each other in a sensing station mounted on a frame of said carton sealing machine and a power source for said control unit, and wherein said box feed sensor activates said control unit when said box feed sensor senses a carton to be taped in a tape applying position.

7. A tape monitoring system as defined in claim 6 wherein said box feed sensor combines with said tape feed sensor through said control unit to detect box jamming of a carton in said tape applicator.

8. A tape monitoring system as defined in claim 6 wherein said miss-feed sensor is coupled to said control unit via a time delay means requiring a selected time delay before said control unit generates said alarm signal.

* * * * *